US010286446B2

(12) United States Patent
Kuster et al.

(10) Patent No.: US 10,286,446 B2
(45) Date of Patent: May 14, 2019

(54) SPRAY NOZZLE DEVICE, IN PARTICULAR FOR SPRAYING A CAST STRAND

(71) Applicant: SMS CONCAST AG, Zurich (CH)

(72) Inventors: Louis Kuster, Ebikon (CH); Klaus Von Eynatten, Tavagnacco (IT)

(73) Assignee: SMS Concast AG, Zurich (CH)

( * ) Notice: Subject to any disclaimer, the term of this patent is extended or adjusted under 35 U.S.C. 154(b) by 0 days.

(21) Appl. No.: 14/620,275

(22) PCT Filed: Aug. 13, 2013

(86) PCT No.: PCT/EP2013/066923
§ 371 (c)(1),
(2) Date: Feb. 12, 2015

(87) PCT Pub. No.: WO2014/026992
PCT Pub. Date: Feb. 20, 2014

(65) Prior Publication Data

US 2015/0231694 A1 Aug. 20, 2015

(30) Foreign Application Priority Data

Aug. 15, 2012 (EP) ..... 12005888

(51) Int. Cl.

| | |
|---|---|
| ***B05B 7/04*** | (2006.01) |
| ***B05B 15/65*** | (2018.01) |
| ***B22D 30/00*** | (2006.01) |
| ***B22D 11/124*** | (2006.01) |

(52) U.S. Cl.
CPC ..... *B22D 11/1246* (2013.01); *B05B 7/0483* (2013.01); *B22D 11/124* (2013.01); *B22D 30/00* (2013.01); *B05B 15/65* (2018.02)

(58) Field of Classification Search
CPC ... B05B 7/0483; B05B 7/0861; B05B 15/065; B05B 7/0416; B05B 7/0012;
(Continued)

(56) References Cited

U.S. PATENT DOCUMENTS 4,116,382 A * 9/1978 Clerk ..... B05B 7/10 239/372
4,343,434 A * 8/1982 Haruch ..... B05B 1/265 239/390

(Continued)

FOREIGN PATENT DOCUMENTS

DE 19505647 A1 8/1996
DE 19841401 A1 4/2000

(Continued)

OTHER PUBLICATIONS

Abstract of JP 2005-131486 A.

(Continued)

*Primary Examiner* — Jason J Boeckmann
*Assistant Examiner* — Cody J Lieuwen
(74) *Attorney, Agent, or Firm* — Brian Roffe

(57) ABSTRACT

Spray nozzle device for spraying a cast strand or similar metallurgical products with a misty air/water mixture for uniformly cooling the cast strand. The air/water mixture is produced in a mixing chamber which acts as a diffusor and includes an air inlet, a water inlet, and a nozzle outlet approximately in alignment with the air inlet. The air inlet is arranged in an air inlet nozzle, the tip of which protrudes into an upper region of the mixing chamber and preferably has air outlet holes oriented perpendicular to a longitudinal axis of the mixing chamber. Water enters near the tip through at least one water outlet hole oriented perpendicular to the longitudinal axis and placed such that the water jet exiting the water outlet hole flows past the air outlet holes. The air flow or air pressure and the water flow or water pressure do not influence each other.

19 Claims, 3 Drawing Sheets

(58) Field of Classification Search
CPC ..... B05B 15/65; B22D 11/1246; B22D 30/00; B22D 11/124
USPC ..... 239/432, 433–434, 429–431
See application file for complete search history.

(56) References Cited

U.S. PATENT DOCUMENTS

| | | | | |
|---|---|---|---|---|
| 4,349,156 | A | 9/1982 | Haruch et al. | |
| 4,591,099 | A | 5/1986 | Emory et al. | |
| 4,793,554 | A * | 12/1988 | Kraus | A01G 15/00 239/14.2 |
| 8,631,854 | B2 | 1/2014 | Dratva et al. | |
| 2001/0000600 | A1* | 5/2001 | Ito | B01J 8/1827 208/113 |
| 2001/0043888 | A1* | 11/2001 | Ito | B01J 8/1827 422/140 |
| 2002/0134862 | A1 | 9/2002 | Fehct et al. | |
| 2007/0069049 | A1 | 3/2007 | Lipthal et al. | |
| 2011/0049258 | A1* | 3/2011 | Lehner | F25C 3/04 239/2.2 |
| 2012/0037331 | A1 | 2/2012 | Meier et al. | |
| 2013/0186982 | A1* | 7/2013 | Vidusek | B05B 7/0433 239/429 |

FOREIGN PATENT DOCUMENTS

| | | | |
|---|---|---|---|
| EP | 1356868 | A1 | 10/2003 |
| JP | 2005131486 | A * | 5/2005 |
| WO | 2014026992 | A3 | 2/2014 |

OTHER PUBLICATIONS

Abstract of DE 19505647 A1.
Abstract of DE 19841401 A1.
Abstract of EP 1356868.

* cited by examiner

SPRAY NOZZLE DEVICE, IN PARTICULAR FOR SPRAYING A CAST STRAND

FIELD OF THE INVENTION

The invention relates to a spray nozzle device, in particular for spraying a cast strand, with a mixing body that has a mixing chamber acting like a diffusor and which is provided with an air inlet, a water inlet and a nozzle outlet disposed on the side lying opposite the air inlet and through which an air/water mixture passes out.

BACKGROUND OF THE INVENTION

As is well known, spray nozzles of this type are used to cool a cast strand during casting. One strives here for the most even cooling effect possible in order to prevent cracks from being able to occur in the hot cast strand during the cooling process. Hence the efforts to design the spray nozzle such that the cooling jet delivered is structurally homogeneous. However, the respectively required cooling effect is different from case to case, both for technical reasons and due to the dimensions and/or the geometry of the format to be cast. For this reason the conditions of use of the spray nozzle are variable with regard to the air and/or water pressure and the air and/or water flow.

It is a disadvantage of the previously known spray nozzles of this type that in the latter both sizes influence one another during operation. This leads to uneven subjection of the cast strand to water drop accumulations that form here and there and which have an adverse effect locally upon the cooling effect of the jet of spray to an inadmissible extent.

A spray nozzle arrangement of this type is disclosed by EP-0 161 307. This consists of a pre-atomizing head and a nozzle mouth piece with its own mixing chamber that is provided with a delivery opening for narrow fan-shaped spray patterns. The sense and purpose of the arrangement is to generate with such spray patterns a spray jet that has a high degree of atomization and that contains liquid droplets of uniform size over the entire length and width. The problems deriving from the influence of the air and water pressure or the air and water flow upon one another are not resolved satisfactorily.

OBJECTS AND SUMMARY OF THE INVENTION

The object underlying the invention is to devise a spray nozzle of the type specified at the start that guarantees a high degree of atomisation and high consistency of the spray jet independently of the casting process or the format of the product to be cooled. Furthermore, this should also be guaranteed independently of the media pressures set.

According to the invention this object is achieved in that the air inlet has a region protruding into the mixing chamber and is provided here with at least one air outlet hole orientated approximately transversely to the longitudinal axis of the mixing chamber, while the water inlet takes place through at least one hole orientated approximately transversely to the longitudinal axis close to the tip of the air inlet.

As corresponding tests have shown, it is an advantage of this arrangement that within the latter the air flow or the air pressure and the water flow or the water pressure do not influence one another to an appreciable degree, and so with changes to these sizes for procedural reasons or reasons related to format, the cooling jet delivered by the spray nozzle remains stable as regards the degree of atomization and the consistency of the cooling jet.

The invention makes provision such that the air inlet of the mixing body is formed by an aperture protruding into the mixing chamber and which is provided with at least one radial outlet hole arranged distributed around the circumference in a plane transverse to its longitudinal axis. In this way production, assembly and maintenance of the spray nozzle is simplified.

It is advantageous here if the region of the air inlet nozzle protruding into the mixing chamber has an outside diameter of less than half the inside diameter of the mixing chamber.

It is advantageous for the mode of operation of the mixing body that is striven for if the radial outlet holes are at an angle of 90°+/−max. 15° transversely to the longitudinal axis of the mixing chamber.

The air inlet nozzle can also additionally be provided with an air outlet hole orientated in the axial direction of the mixing chamber.

It is also advantageous for the mode of operation of the spray nozzle if its mixing chamber is cylindrical in form and has a length preferably twice that of the inside diameter.

The invention also makes provision such that the mixing body has a replaceable nozzle head with an outlet opening for the air/water mixture the geometry of which can be determined according to the respectively required spray pattern. In this way the nozzle can easily be adapted to variable conditions of use.

BRIEF DESCRIPTION OF THE DRAWINGS

The invention and other advantages of the latter are described in more detail below by means of an exemplary embodiment with reference to the drawings. These show as follows.

DETAILED DESCRIPTION OF THE INVENTION

Figure 1:
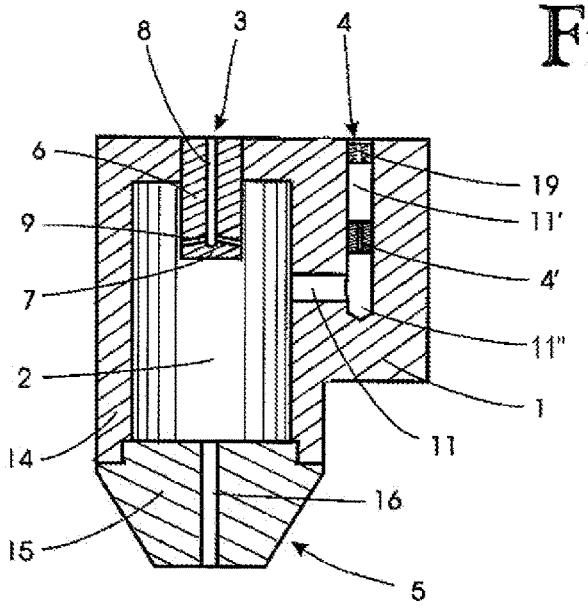
FIG. 1 shows a mixing body according to the invention of a spray nozzle device, shown in section and diagrammatically.
Figure 2:
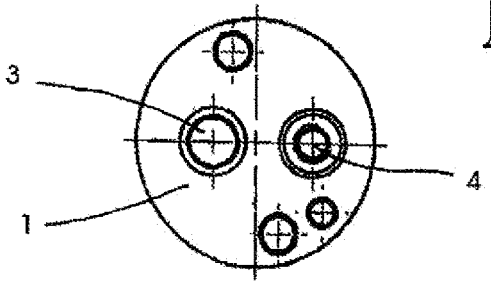
FIG. 2 shows the spray nozzle device according to FIG. 1, in a view shown in the direction of arrow II.

The spray nozzle device according to FIG. 1 to FIG. 4 services to spray a cast strand with an air/water mixture in order to cool it during casting. The mixing body 1 has a mixing chamber 2 that is provided with an air inlet 3, a water inlet 4 and a nozzle outlet 5.

The mixing chamber 2 of the mixing body 1 is cylindrical in form. Its length is approximately twice the inside diameter of the mixing chamber 2. The air inlet 3 is disposed in an air inlet nozzle 6, the tip 7 of which protrudes into the upper region of the mixing chamber 2. The air inlet nozzle 6 is orientated coaxially to the mixing chamber 2, and its outside diameter is smaller here than half the inside diameter of the mixing chamber 2. In this region, the air inlet nozzle 6 is provided with air outlet holes 9 passing radially out of the mixing chamber 2 approximately transversely to a longitudinal axis of the mixing chamber 2 and which are distributed evenly around the circumference in a plane transverse to the longitudinal axis. Air inlet nozzle 6 also includes a main air outlet hole 8 oriented in the axial direction of the mixing chamber 2.

The water inlet 4 discharges into the mixing chamber 2 close to the tip 7 of the air inlet 3 with a water outlet hole 11 oriented transversely to its longitudinal axis and the distance of which from the tip 7 is such that the water jet flowing out of the water outlet hole 11 does not affect the air outlet holes 9. The spray nozzle described is equipped with just one water outlet hole. However, it can in principle also be provided with a number of water outlet holes distributed around the circumference.

The water inlet 4 is formed by a hole 11' running approximately parallel to the longitudinal axis of the mixing body 1 and by the transverse water outlet hole 11. Contained within the hole 11' is initially a replaceable filter 19 and then an aperture 4', and it is additionally provided with an over-hole 11" which is formed as an extension passing from the transverse water outlet hole 11 and serves to calm the water conveyed into the water outlet hole 11.

Furthermore, the radial air outlet holes 9 are made at a slight angle to the perpendicular plane, the angle of inclination being able to vary within a range of +/−maximum 15°. Moreover, the air outlet holes 9 could also be oriented at least approximately tangentially instead of radially, by means of which swirl of the water jet flowing into the mixing chamber 2 is generated which is associated with evenly finely structured atomization of the air/water mixture.

The cylindrically formed mixing body 1 has in an extension of the mixing chamber 2 an appendage 14, which is also cylindrical, to the end of which is attached a replaceable nozzle head 15 with an air/water mixture outlet opening 16. The connection of the nozzle head 15 to the mixing body 1 is disposed in the appendage 14 of the mixing body.

A bayonet closure or a similarly releaseable connection could also be used instead of this type of correctly functioning screw connection. Due to the replaceability of the nozzle head 15 the spray pattern of the nozzle can easily be adapted to the respective conditions of use from case to case depending on the form of the one or the number of outlet openings.

Figure 3:
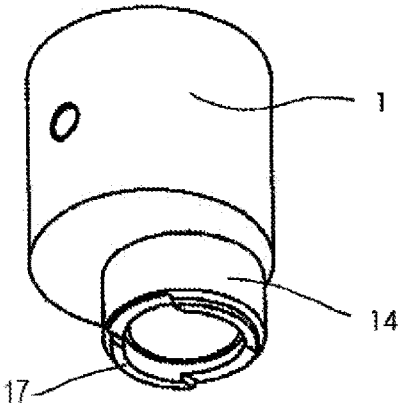
FIG. 3 is a perspective view of the spray nozzle device according to FIG. 1 without a nozzle head.
Figure 4:
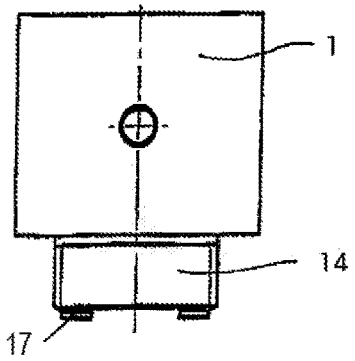
FIG. 4 is a side view of the spray nozzle according to FIG. 1 without a nozzle head.

Furthermore, according to FIG. 3 and FIG. 4 centring means 17 for positioning of the nozzle head 15 with respect to the mixing body 1 are indicated on the lower face side of the cylindrical appendage 14.

An aperture 4' is respectively provided in the air inlet 3 and the water inlet 4 for throttling the delivered air or the water.

Needless to say, the advantages of the spray nozzle according to the invention also apply when another comparable type of gas/liquid mixture is used as coolant instead of the air/water mixture.

Both the air outlet holes and the water outlet holes can be orientated at least approximately tangentially instead of radially.

Figure 6:
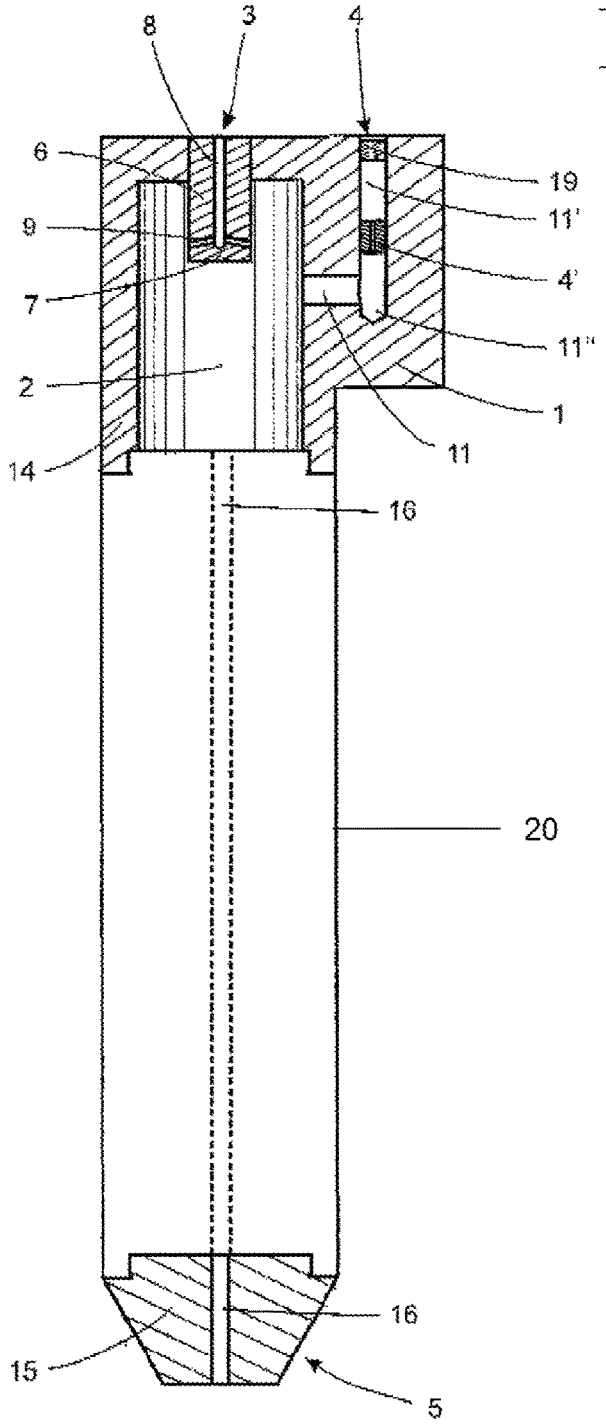
FIG. 6 is a side view of another embodiment of a spray nozzle device in accordance with the invention including an extension pipe.

As shown in FIG. 6, an extension pipe 20 could also be provided between the mixing body 1 and the nozzle outlet 5 if, for example, smaller strand formats are cast.

If operation is interrupted or if casting is halted, air alone may be delivered through the spray nozzle device in order to guarantee sufficient cooling of the latter.

Figure 5:
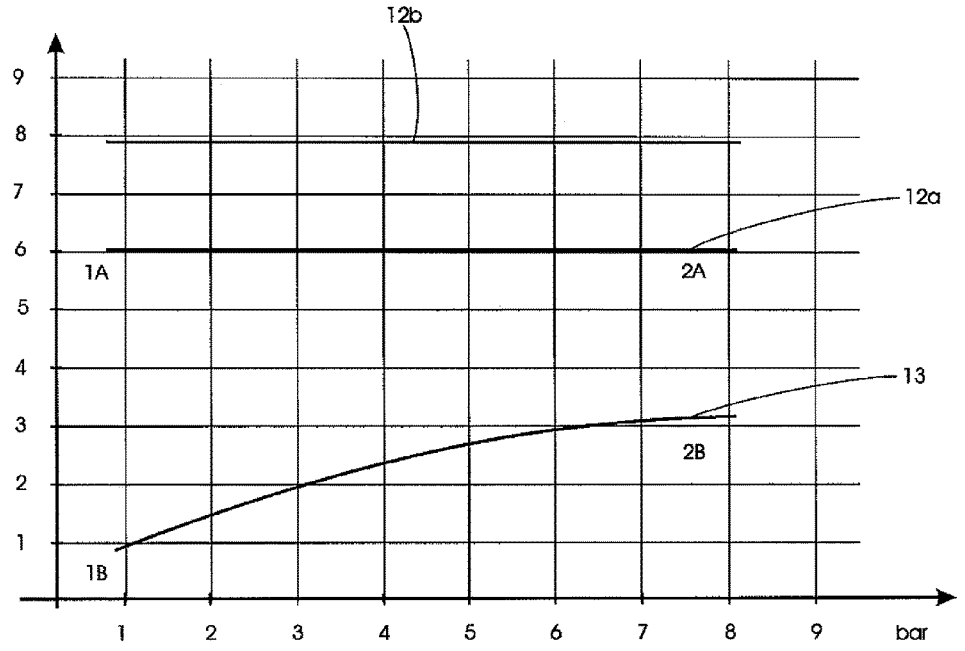
FIG. 5 is a water pressure/water flow diagram for the spray nozzle according to FIG. 1 with two different values for air pressure.

In order to determine the spray output of the nozzle, tests are carried out with variable pressure and flow values. As can be seen from the diagram according to FIG. 5 it emerges from the test results that the two sizes do not influence one another in the spray nozzle according to the invention. The water pressure (bar) is plotted on the x axis and the water and air flow (1/min and $m^3/h$) on the x axis in the diagram. Lines 12*a*, 12*b* and 13 show the air flow sequence 1A-2A and the water flow sequence 1B-2B with a constant air pressure of 2 bar or 3 bar and a constant air flow of 6.0 $m^3/h$ or 7.8 $m^3/h$.

The following pressure and flow values were determined by the tests:

| Example | Air pressure | Water pressure | Air flow | Water flow |
|---|---|---|---|---|
| 1 | 2 bar | 0.5 bar | 1A-2A: 6.0 $m^3/h$ | 1B: 0.81/min |
| 2 | 2 bar | 8.0 bar | 1A-2A: 6.0 $m^3/h$ | 2B: 3.41/min |
| | 3 bar | 0.5 bar | 7.8 $m^3/h$ | 1B: 0.81/min |
| | 3 bar | 8.0 bar | 7.8 $m^3/h$ | 2B: 3.41/min |

It can be gathered from the table that the course of the water flow curve 1B-2B remains constant when the air pressure increases from 2 to 3 bar or when the air flow is increased from 6.0 to 7.8 $m^3/h$. The spray nozzle according to the invention thus guarantees a consistently homogeneous character of the air/water mixture, independently of the respectively required cooling effect. There is therefore mutual independency over a large pressure range of the air and water pressure.

The invention claimed is:

1. A spray nozzle device for spraying a cast strand with a mixture including air and water, comprising:

a mixing body defining a mixing chamber and a water inlet into the mixing chamber;

an air inlet nozzle on a first side of the mixing body and defining an air inlet into the mixing chamber, the air inlet nozzle having a portion protruding into the mixing chamber that includes a tip and defining at least one air outlet hole at the tip, the tip being separated from a second side of the mixing body opposite the first side of the mixing body on which the air inlet nozzle is situated by an open cylindrical portion of the mixing chamber; and a nozzle outlet on the second side of the mixing body opposite the first side on which the air inlet nozzle is situated, the nozzle outlet defining an outlet opening in flow communication with the mixing chamber and through which the mixture including air and water is discharged from the spray nozzle device, the water inlet including a first water outlet hole in the mixing body that extends parallel to a longitudinal axis of the mixing chamber and a second water outlet hole in the mixing body oriented approximately transversely to the longitudinal axis of the mixing chamber, the second water outlet hole being configured to open into the open cylindrical portion of the mixing chamber between the tip and the second side of the mixing body, an outlet of the second water outlet hole being situated closer to an outlet of the at least one air outlet hole at a first end of the mixing chamber than to the outlet opening of the nozzle outlet at an opposite, second end of the mixing chamber and in a position relative to the outlet of the at least one air outlet hole such that water discharged from the second water outlet hole interacts with air discharged from the at least one air outlet hole and swirl of the water is generated at the first end of the mixing chamber, and wherein the mixing chamber is cylindrical and the portion of the air inlet nozzle protruding into the mixing chamber has an outermost outside diameter, and wherein the outermost outside diameter of the portion of the air inlet nozzle protruding into the mixing chamber is less than half an inside diameter of the mixing chamber.

2. The spray nozzle device according to claim 1, wherein the at least one air outlet hole comprises a plurality of air outlet holes distributed around a circumference of the tip in a plane transverse to the longitudinal axis of the mixing chamber.

3. The spray nozzle device according to claim 1, wherein the mixing chamber has a length approximately twice the inside diameter of the mixing chamber.

4. The spray nozzle device according to claim 1, wherein each of the at least one air outlet hole is at an angle of 90°+/−15° to the longitudinal axis of the mixing chamber.

5. The spray nozzle device according to claim 4, wherein the second water outlet hole is positioned such that a water jet operatively flowing out therefrom flows past the at least one air outlet hole.

6. The spray nozzle device according to claim 1, wherein the at least one air outlet hole comprises a plurality of air outlet holes oriented in a circle on a plane transverse to the longitudinal axis of the mixing chamber.

7. The spray nozzle device according to claim 1, wherein the air inlet nozzle further defines a main air outlet hole in flow communication with the at least one air outlet hole and oriented in an axial direction of the mixing chamber.

8. The spray nozzle device according to claim 1, wherein the nozzle outlet comprises a nozzle head removably attached to the mixing body to thereby enable the nozzle head to be replaceable, the nozzle head defining the outlet opening for an air/water mixture from the mixing chamber.

9. The spray nozzle device according to claim 1, further comprising an extension pipe between the mixing body and the nozzle outlet.

10. The spray nozzle device according to claim 1, wherein the water inlet includes a water throttling aperture for throttling water.

11. The spray nozzle device according to claim 10, wherein the water throttling aperture is situated in the first water outlet hole.

12. The spray nozzle device according to claim 1, wherein the water inlet further includes an over-hole as an extension of the first water outlet hole at a region at which the first water outlet hole and the second water outlet hole meet to thereby calm water conveyed into the second water outlet hole.

13. The spray nozzle device according to claim 1, wherein the first side of the mixing body on which the air inlet nozzle is situated is an upper side and the second side of the mixing body on which the nozzle outlet is situated is a lower side, the portion of the air inlet nozzle including the tip protruding into an upper region of the mixing chamber.

14. The spray nozzle device according to claim 1, wherein the air inlet nozzle and the second water outlet hole are arranged relative to one another such that when water is discharged from the second water outlet hole into the mixing chamber, the water is discharged at a distance from the tip such that the water does not affect the at least one air outlet hole.

15. The spray nozzle device according to claim 1, wherein the air inlet nozzle is oriented coaxially to the mixing chamber.

16. The spray nozzle device according to claim 1, wherein the mixing body includes an appendage defining an extension of the mixing chamber, the nozzle outlet being attached to an end of the appendage.

17. The spray nozzle device according to claim 16, wherein the nozzle outlet comprises a nozzle head, further comprising a centering structure on the appendage and configured to position the nozzle head with respect to the mixing body.

18. The spray nozzle device according to claim 1, wherein the second water outlet hole is radially oriented.

19. The spray nozzle device according to claim 1, further comprising a filter arranged in the first water outlet hole.

* * * * *